US005940893A

United States Patent [19]

Shum

[11] Patent Number: 5,940,893

[45] Date of Patent: Aug. 24, 1999

[54] FEASIBLE ODORLESS WATER CLOSET

[76] Inventor: Hai Shum, 392 Hans Way, San Jose, Calif. 95133

[21] Appl. No.: 09/084,755

[22] Filed: May 26, 1998

[51] Int. Cl.[6] ..... E03D 9/052

[52] U.S. Cl. ..... 4/213

[58] Field of Search ..... 4/213

[56] References Cited

U.S. PATENT DOCUMENTS

| | | | |
|---|---|---|---|
| 4,031,574 | 6/1977 | Werner | 4/213 |
| 4,166,298 | 9/1979 | Pearson | 4/213 |
| 4,583,250 | 4/1986 | Valarao | 4/213 |
| 4,590,629 | 5/1986 | Lusk | 4/213 |
| 5,718,005 | 2/1998 | Ng | 4/213 |

*Primary Examiner*—Robert M. Fetsuga

[57] ABSTRACT

Apparatus attached to an existing water closet for continuously evacuating odorous gas from the closet bowl through the overflow pipe and into the tank water during use of the water closet. A low voltage DC power supply and air blower are employed to create a vacuum situation inside a chamber sealed around the upper end of the overflow pipe. The chamber is assembled from four joined cylinders of varying size and shape. The odorous air is withdrawn from the bowl, compressed and exhausted into the tank water through an air duct having diffusers below the water surface.

2 Claims, 6 Drawing Sheets

FEASIBLE ODORLESS WATER CLOSET

BACKGROUND OF THE INVENTION

Venting or deodorizing the water closet is a subject that has been attacked by many pioneer inventors for many years. Among all the prior arts, three categories can be found. The first one is to solve the problem by adapting a newly designed bowl or remodeling the bathroom wall where an additional vent pipe is installed. The second one is to install venting devices inside the seat or the tank cover. The third one where this invention belongs to is to utilize the existing water closet structure and mechanism. The main apparatus of this deodorizing device is hidden inside the tank. The cost of production is the lowest, the use and installation are the easiest among these three categories. This is the only feasible one for every household. Although some inventions in this group seem to be heavy, applying excessive weight and torsion onto the overflow pipe; this invention is emphasized light weight of the embodiment, less than one half pound. The center of weight and spinning force is balanced at the axis of the embodiment that shares the same axis of the overflow pipe. Utilizing active water closet deodorizer will result in a comfortable environment and great saving of water, which is a global wide precious natural resource of the next century. This invention has a blight future.

SUMMARY OF THE INVENTION

Among all the inventions in this intent, this one is the most feasible. It maximized the usage of existing water closet components and mechanism, minimized the complicity of the preferred embodiment. The simplicity of this invention extends the benefit into its low cost of mass production affordable by every household, adaptable into most existing residential water closets. It requires no tool or only a few household hand tools, for installation, depends on the bathroom setting and the water closet configuration.

By utilizing one air chamber, inducing odorous gas laden air from the bowl became possible.

By utilizing one manual switch and one automatic switch, it is very easy to operate.

By utilizing several air diffusers at the end of exhaust air duct, water in the tank is used as a filter and dissolvent. Water is also used as a motor vibration attenuater, buffer and noise absorbent.

By utilizing this invention the existing overflow pipe is given an additional function, which is a conduit of upward air flow pumped by the air blower.

By utilizing this invention, original water closet function won't be interrupted in any way. Bathroom atmosphere became friendly. It is hardly noticeable after its installation, except a short thin wire, a switch and a battery box that can be decorated to fit into different room environment.

By utilizing a ball bearing, brushless DC motor, this deodorizer is very quiet during operation. The sound of air bubbles coming out of water may be the only noticeable.

By utilizing non-rusting, resilient material, this deodorizer is long lasting.

By utilizing this deodorizer, flush the water closet becomes necessary only at the end of each use. This gives a great water saving.

DESCRIPTION OF THE DRAWINGS

The accompanying drawings of the preferred embodiment of this invention are here in described.

DETAILED OPERATION DESCRIPTION OF THE INVENTION

Figure 1:
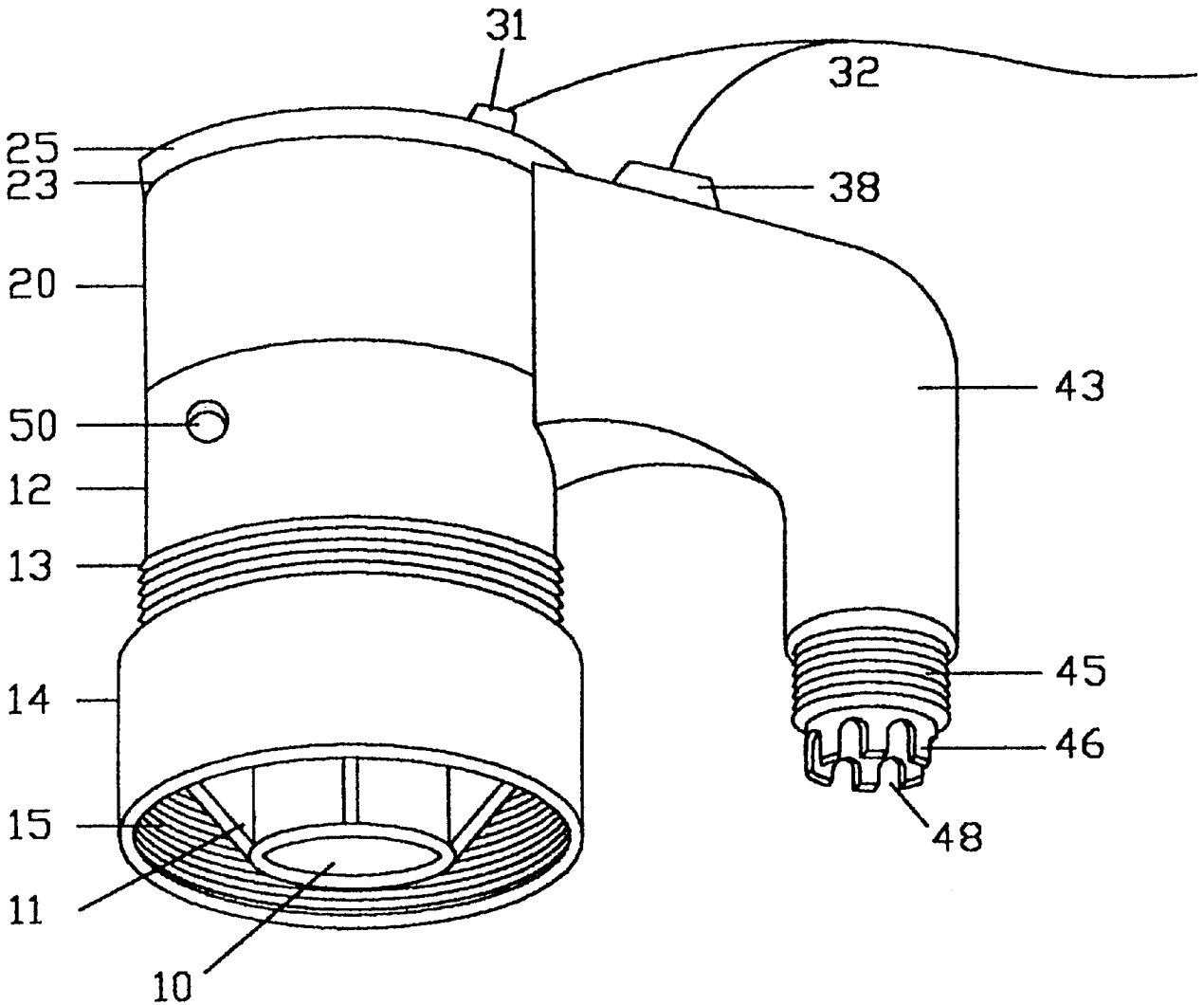
FIG. 1. Perspective view of the preferred embodiment.

Referring to the drawings, FIG. 1 shows the perspective view of the preferred embodiment of the invention, cylinder 10 with four brace members 11 linking and supporting a larger cylinder 12 sharing common axis. Cylinder 12 has ridged spiral threads 13 in its lower portion coupling with the grooved spiral threads 15 of a larger cylinder 14 allowing the cylinder 14 to travel vertically, providing a sealed air chamber within cylinder 12 when lower portion of cylinder 14 is submerged into water in the water tank 61.

Opening 50 on cylinder 12 is for the refill tube 65 to be inserted into.

Cylinder 20 seating on the top of cylinder 12 is the housing for an air blower 30. A dome lid 25 on top of cylinder 20 avoids water accumulation. Air duct 43 with grooved spiral threads 44 in its lower section coupling with ridged spiral threads 45 on air duct 46 allowing duct 46 to travel vertically to submerge six air diffusers 48 into water with correct depth.

Figure 2:
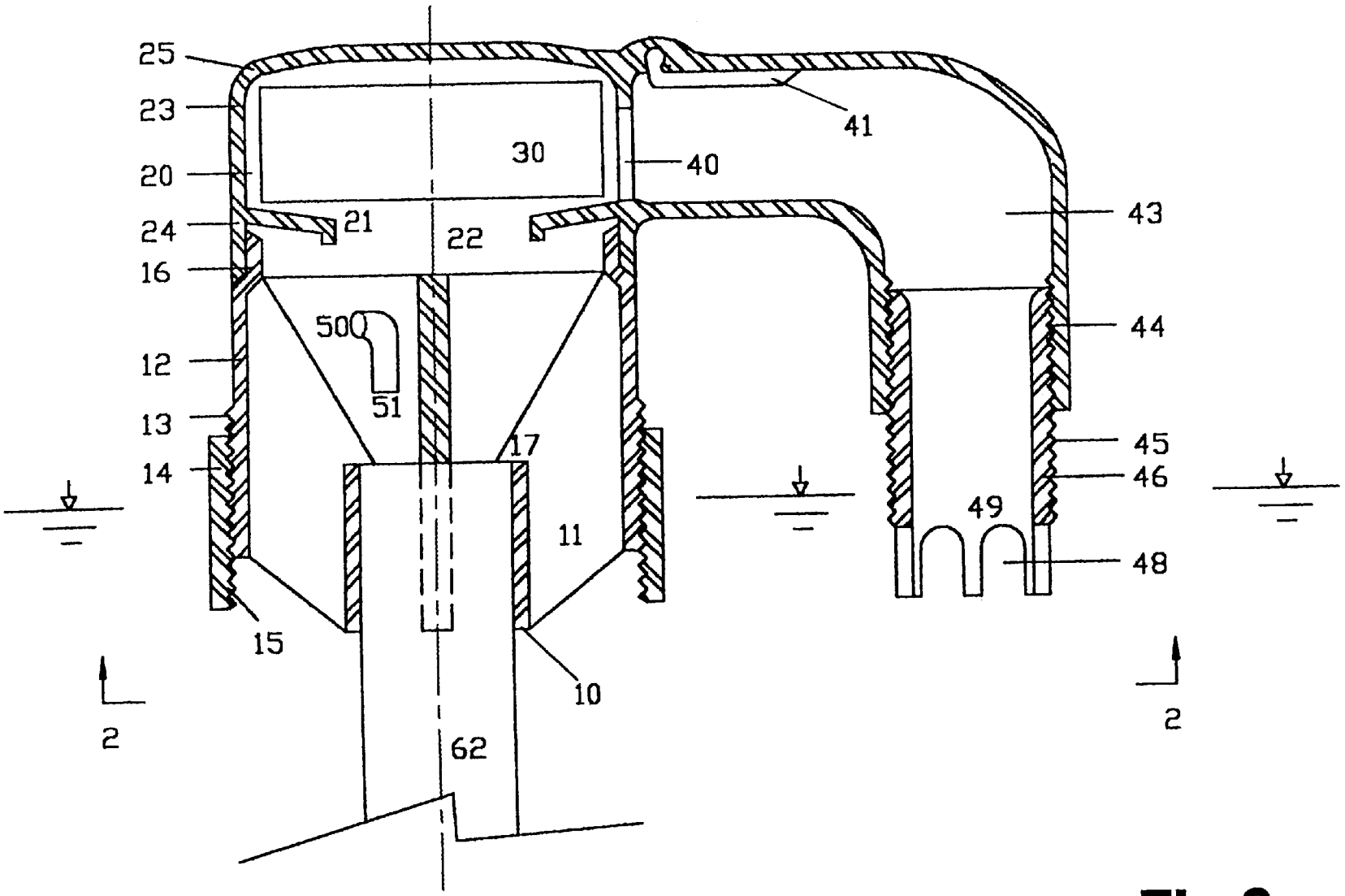
FIG. 2. Vertical view taken along line A—A of FIG. 3.
Figure 3:
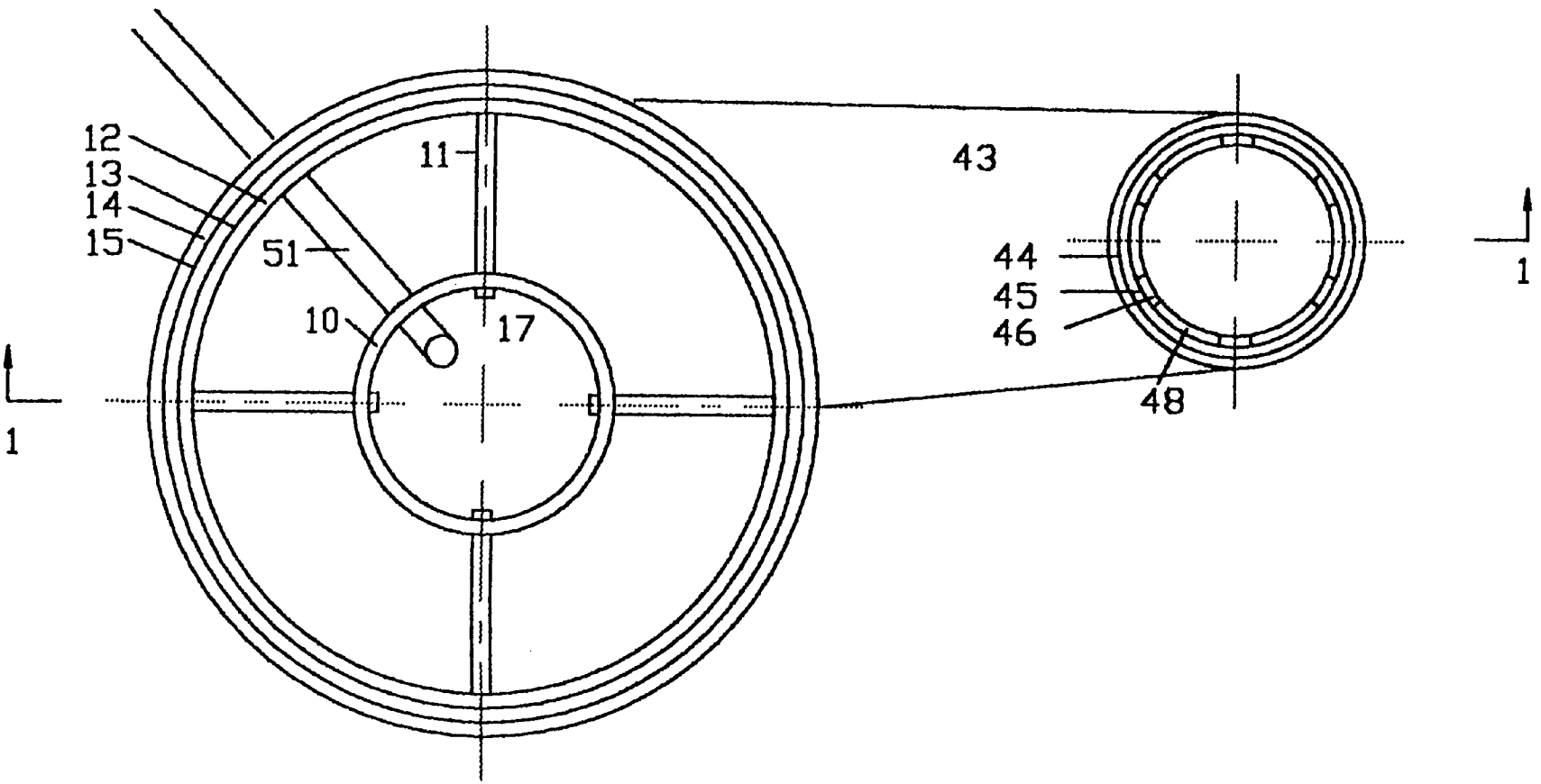
FIG. 3. Horizontal view taken along line B—B of FIG. 2.

FIG. 2, FIG. 3 reveal more details of the invention. The four supporting brace members 11 have their upper hypotenuse side corners 17 extending one sixteenth inch toward the center axis of the cylinders 10, 12.

Extension of refill tube 51 turns ninety degree aiming the overflow pipe 62, It has one half inch clearance for the U.S. standards.

Top opening 16 of cylinder 12 has a reduced diameter, is coupled into lower opening 24 of air blower housing 20 with air tight slide fitting. Housing 20 can be rotated in reference to cylinder 12 that is stationary, letting the device easily adapted into different water tank mechanism configurations.

Opening 22 at the bottom of housing 20, has its diameter one eighth inch larger than cylinder 10, and in a slope 21 down towards the center. Distance between opening 22 and the top edge of cylinder 10 is one and one half inch; also, they share the same axis. Any water accumulated in housing 20 should run down along slope 21. Dome lid 25 is permanently sealed to housing 20 along seam 23 after the air blower 30 is installed.

Figure 4:
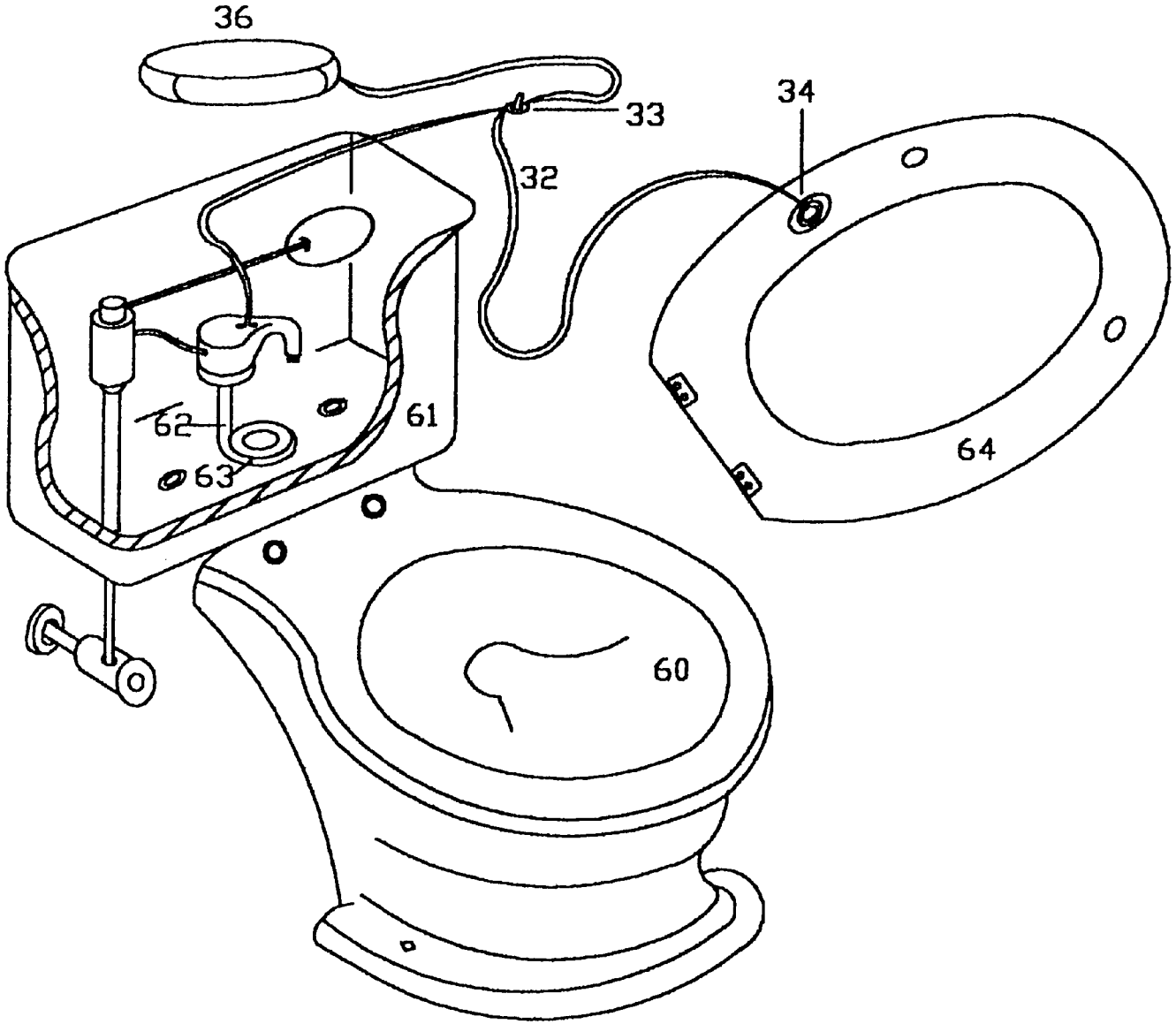
FIG. 4. Over all view of a typical residential water closet, with a partially cut away water tank wall to show the interior and a removed seat to show the position of the automatic switch.
Figure 5:
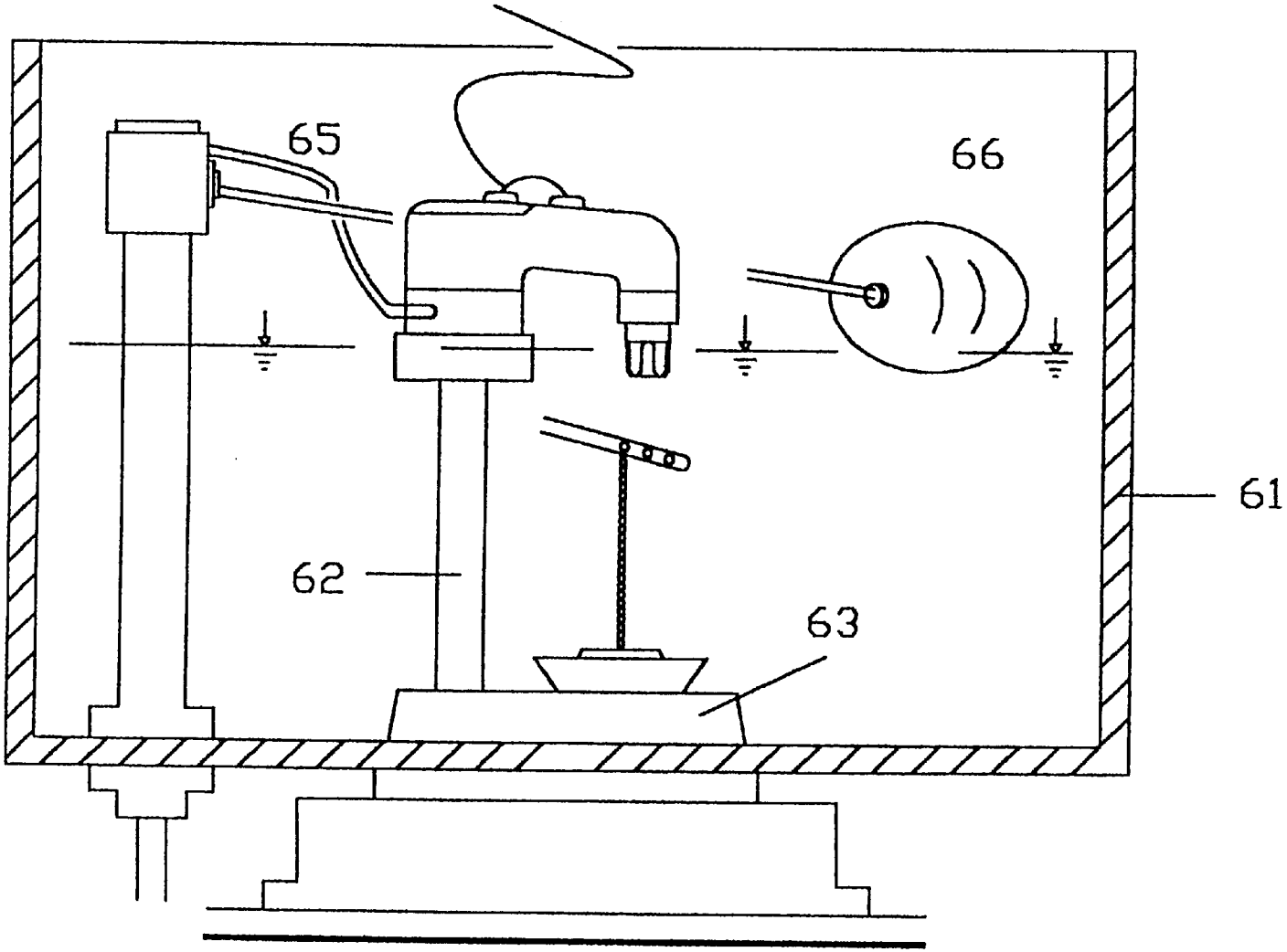
FIG. 5. The installed preferred embodiment of this invention in relationship with water tank mechanism and the correct water level setting.

FIG. 4 shows the wiring diagram of the electric circuit and the control switches in relationship with the entire water closet. Air blower 30 is powered by a group of eight or ten batteries 35 supplying 12 v or 15 v DC respectively. Batteries 35 are in a box 36 sitting on the top of tank cover 63. A manual switch 33 and an automatic switch 34 are connected by wires 32 in series between the air blower 30, the electric magnet 38 and the battery box 36. Manual switch 33 is situated in a convenient location of the water closet user. The automatic switch 34 is fixed at the bottom side of the seat 64 actuated only when the weight of a user is applied onto it. Wires 32 are connected to the air blower 30 through terminal 31 on the top of the lid 25.

Opening 40 gives passage for the exhaust compressed air from air blower 30, when switches 33,34 are turned on, the energized electric magnet 36 keeps valve 41 fully open, gives maximum air flow passage. When switches 33,34 are turned off, valve 41 closes the opening 40 to prevent or reduce the intrusion of moisture coming into the air blower 30 from air ducts 46,43. Air ducts 43,46 are coupled by threads 44,45. Six air diffusers 48 have their top line in arch shape 49 to increase the diffusion efficiency.

The cylinder 10 is adapted onto the top end of the overflow pipe 62 in a tight sliding fit. Extender corners 17 limit and fix the vertical position of the device. The insertions of the refill tube 65 into opening 50 and the tubular cylinder 10 onto the top end of overflow pipe 62 are the only mechanical engagement to be done to install this device to an existing water closet.

Cylinder 14 is adjusted to have its lower portion about one half inch submerged into water to create a completely sealed air chamber above and around the top opening of overflow pipe 62 within cylinder 12. With its lower potion merged in water, cylinder 14 serves as a stabilizer, attenuates the vibration generated from the air blower 30, from transmitting to the overflow pipe 62, prevents or reduces the wear and tear of the overflow pipe.

The water level in the tank 61 is set to a predetermined level by the floater 66 and associated mechanism. The diffusers 48 at the end of duct 46 are adjusted to have water surface slightly above their arches 49 during its installation.

When the seat 64 is down, the weight of user turns on the air blower 30 and the electric magnet 38, opens the valve instantaneously. Air with odorous gas is pumped through overflow pipe 62 into air ducts 43,46 and diffusers 48. Exuberant air bubbles and water ripples are generated around diffusers 48. The air duct 46 may be re-adjusted to ensure this bubble and ripple effects to increase the efficiency. Water in the tank 61 is served as a filter and a dissolvent, when air returns to the water surface it is no longer carrying odorous gas.

The water is also served as a load and a impedance to absorb the energy released from the air blower 30. At a typical speed of 2500 rpm, the high speed rotate motion of the air blower 30 may trig a resonance causing a permanent damage to the mechanism. The presence of water attenuates this possibility to a virtual zero. The water also gives a small amount of buoyancy to the device when the lower portion of the device is submerged in it. It is benefited from this buoyancy for reducing the burden of the overflow pipe 62, although the amount of this buoyancy is very small and the entire weight of the device is only one half pound including air blower 30 and magnet 38.

Figure 6A:
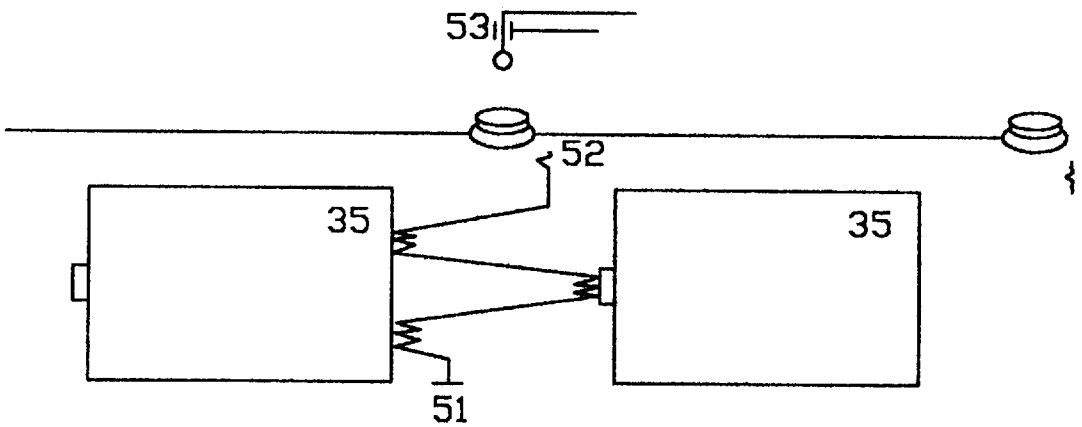
FIG. 6*a*. Detail of the voltage center tap between batteries.
Figure 6B:
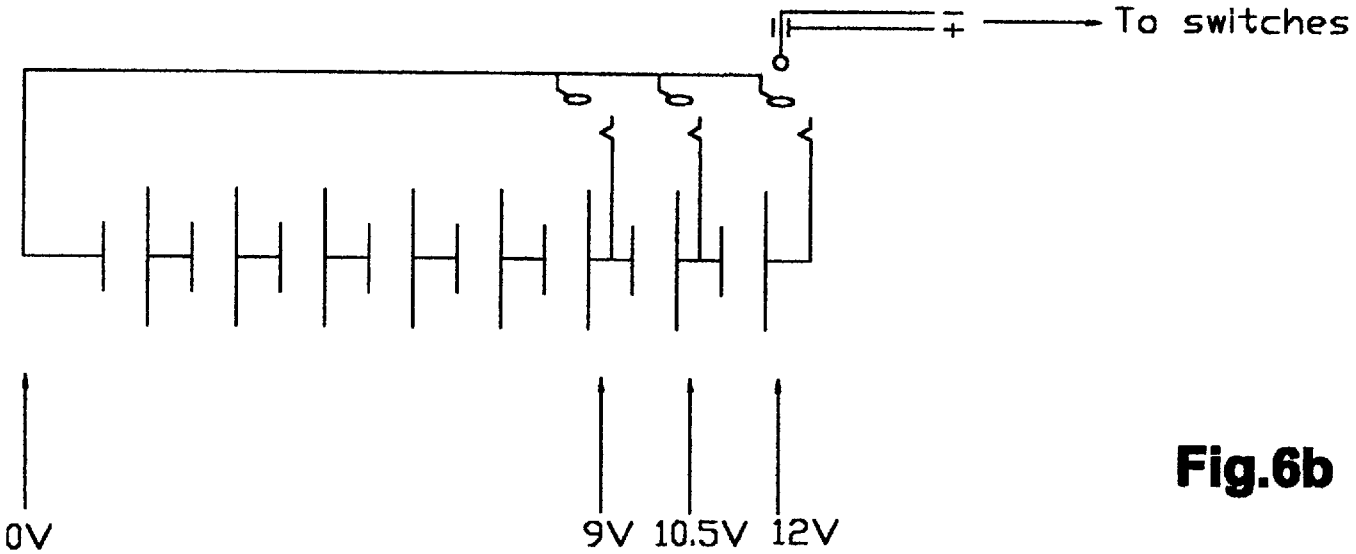
FIG. 6*b*. Schematic diagram of the power supply.

The battery box 36 contains eight or ten 1.5 v D size batteries 35, supplying 12 v or 15 v respectively. Batteries 35 are arranged with necessary wiring and accessories—three phone jacks 52 and one phone plug 53 and two specially designed spacer-contacts 51 to provide voltage tap out to offer tiers of supply voltages 9 v, 10.5 v, 12 v. For the 15 v, 10 battery supply, it may use five phone jacks 52, one phone plug 53 and four special spacer-contact 51 arranged same way to offer more tiers of supply voltages 9 v, 10.5 v, 12 v, 13.5 v, 15 v. User selects the voltage supply to the air blower 30 to set a comfortable air flow. Schematic diagram of the 12 v, 8 battery power supply and the arrangement of the accessories are shown in FIG. 6*a,* and FIG. 6*b*.

The utilization of this device does not interfere the original normal function of the overflow pipe 62, to spill excessive water in the tank 61 and to vent the discharge conduit 63 during flush. The preferred embodiment is made from non-rusting resilient material, such as plastic or nylon. The air blower 30 is ball bearing and brushless, typical running speed of 2500 rpm.

I claim:

1. A deodorizing device adaptable into a water closet including a water tank and a bowl and a discharge conduit linking the tank and bowl, the water surface in the tank set automatically to a predetermined normal level by a floater and associated mechanism, and a substantially vertically oriented overflow pipe having a lower end connected to the discharge conduit and an upper end above the water surface, said deodorizing device comprising:

a cylindrical rigid tube having a vertical axis adapted to be installed on the overflow pipe upper end concurrent with the vertical axis thereof, said tube defining an air chamber above the overflow pipe upper end, said tube including a vertically adjustable ring coupled to a lower end thereof, said air chamber being sealed from the tank interior when a lower end of said ring is submerged below the water surface;

a tubular adapter positioned within said cylindrical tube at a lower end portion thereof and slidingly fittable onto said overflow tube upper end;

a plurality of brace members supporting said tubular adapter within said cylindrical tube;

a compartment coupled to an upper end of said cylindrical tube;

an air blower positioned in said compartment concurrent with said cylindrical tube vertical axis and overflow pipe vertical axis to centralize the weight and balance the spinning force of said blower;

a refill tube extension communicating with said air chamber;

an air duct coupled to said compartment for directing compressed air towards the water surface, said air duct including an adjustable duct coupled to a lower end thereof, said adjustable duct having a plurality of air diffusers at a lower end for directing compressed air below the water surface; and valve means between said air duct and said chamber for providing resistance to water vapor intrusion to said blower.

2. The deodorizing device of claim 1, further comprising a battery box and means for controlling operation of said blower.

* * * * *